US011358270B2

(12) United States Patent
Fuller

(10) Patent No.: US 11,358,270 B2
(45) Date of Patent: Jun. 14, 2022

(54) DRUM SPEED KEY TOOL

(71) Applicant: Stephen Austin Fuller, Denton, TX (US)

(72) Inventor: Stephen Austin Fuller, Denton, TX (US)

( * ) Notice: Subject to any disclaimer, the term of this patent is extended or adjusted under 35 U.S.C. 154(b) by 328 days.

(21) Appl. No.: 16/751,914

(22) Filed: Jan. 24, 2020

(65) Prior Publication Data

US 2020/0238499 A1 Jul. 30, 2020

Related U.S. Application Data

(60) Provisional application No. 62/796,905, filed on Jan. 25, 2019.

(51) Int. Cl.

| | |
|---|---|
| ***B25G 1/00*** | (2006.01) |
| ***G10D 13/16*** | (2020.01) |
| ***B25B 13/48*** | (2006.01) |

(52) U.S. Cl.

CPC ..... *B25G 1/005* (2013.01); *B25B 13/48* (2013.01); *G10D 13/16* (2020.02)

(58) Field of Classification Search

CPC ..... G10D 13/16; B25G 1/005; B25G 1/007; B25G 1/107; B25B 13/48; G10G 7/00

See application file for complete search history.

(56) References Cited

U.S. PATENT DOCUMENTS

| | | | | | |
|---|---|---|---|---|---|
| 3,388,622 | A * | 6/1968 | Klang | B25G 1/007 | 81/177.85 |
| 5,706,709 | A * | 1/1998 | Snow | B25G 1/007 | 81/177.1 |
| D404,986 | S * | 2/1999 | Mahon | D17/22 | |
| 6,095,018 | A * | 8/2000 | Schuster | B25B 15/02 | 81/35 |
| 7,905,162 | B2 * | 3/2011 | Nguyen | B25B 13/462 | 81/57.3 |
| 10,040,185 | B2 * | 8/2018 | Davis | B25F 1/04 | |
| 10,207,398 | B2 * | 2/2019 | Ma | B25B 15/005 | |
| D897,813 | S * | 10/2020 | Parks | D8/105 | |
| D897,814 | S * | 10/2020 | Parks | D8/105 | |
| 2003/0159550 | A1 * | 8/2003 | Shigenaga | B25G 1/005 | 81/437 |
| 2008/0028899 | A1 * | 2/2008 | Scott | B25G 1/007 | 81/436 |
| 2009/0183607 | A1 * | 7/2009 | Johnson | B25G 1/007 | 206/349 |
| 2020/0282543 | A1 * | 9/2020 | Grzybowski | B25G 3/26 | |

* cited by examiner

*Primary Examiner* — David B. Thomas

(74) *Attorney, Agent, or Firm* — Stephens Domnitz Meineke PLLC; Matthew C Juren

(57) ABSTRACT

A novel drum speed key tool that provides improved balance and efficiency for the installation, tightening, and removal of drum lug nuts. The drum speed key tool provides a finger receiving cup to allow a user to insert a finger or grip with their hand and efficiently apply rotational force to the drum speed key while maintaining attached to the drum lug nut with reduced slippage of the drum speed key tool from both the user's grip and the drum lug nut.

16 Claims, 4 Drawing Sheets

DRUM SPEED KEY TOOL

This application claims benefit to the priority date of U.S. Provisional Application No. 62/796,905, filed on Jan. 25, 2019.

TECHNICAL FIELD

The novel invention described herein concerns various improvements to tools used for installing, tightening, and removal of drum lugs both in a quick and efficient manner. The invention allows for reduced slippage from both the user's hand and the drum lug itself. The type of tool referenced herein is referred to as a "drum key."

BACKGROUND

FIG. 1 Prior versions of drum keys consist of "L" shaped tools 10 wherein the socket head 11 is affixed to a first end 12 of a lateral member 15 and the handle 13 being affixed to the second end 14 of the lateral member 15. When prior versions of drum keys are oriented in a position where the handle is superior to the socket head, the socket head is posed on the underside of the lateral member while the handle is posed on the upperside of the later member. The axis of rotation 17 when the socket head is mated with a drum lug is directly in line with the lug. The offset handle of the "L" shaped key is unbalanced causing it to the wobble or fall off the drum lug when rotational force is applied to the key. The "L" shaped key is not sturdy or balanced enough to be efficiently operated with one hand, but instead commonly requires two hands to be optimally operated and stay affixed to the drum lug during rotation.

Other prior drum keys may take the form of a "T-handle" tool 20. FIG. 1 The T-handle drum key may be made of one or more pieces, but requires the user to grip a perpendicular member 21 to apply rotational force to the member 22 affixed to the socket head 23. Prior drum keys are typically made of a single piece of metal or plastic. FIG. 1 provides depictions of prior drum keys.

SUMMARY OF INVENTION

The novel drum speed key tool described herein allows for a drum user to quickly and efficiently tighten drum lugs and improves upon earlier versions of drum keys found in the marketplace. The improvements described herein comprise improvements to the gripping handle of a drum key by replacing the typical rod with a receiving cup. The receiving cup allows a user to preferably insert his or her finger into the receiving cup and then proceed to spin the drum speed key allowing quick and efficient tightening of the drum lugs. The user's finger then becomes the driving force without the need for re-adjustment of the user's grip on the tool during tuning operations.

DESCRIPTION OF EMBODIMENTS

Figure 1:
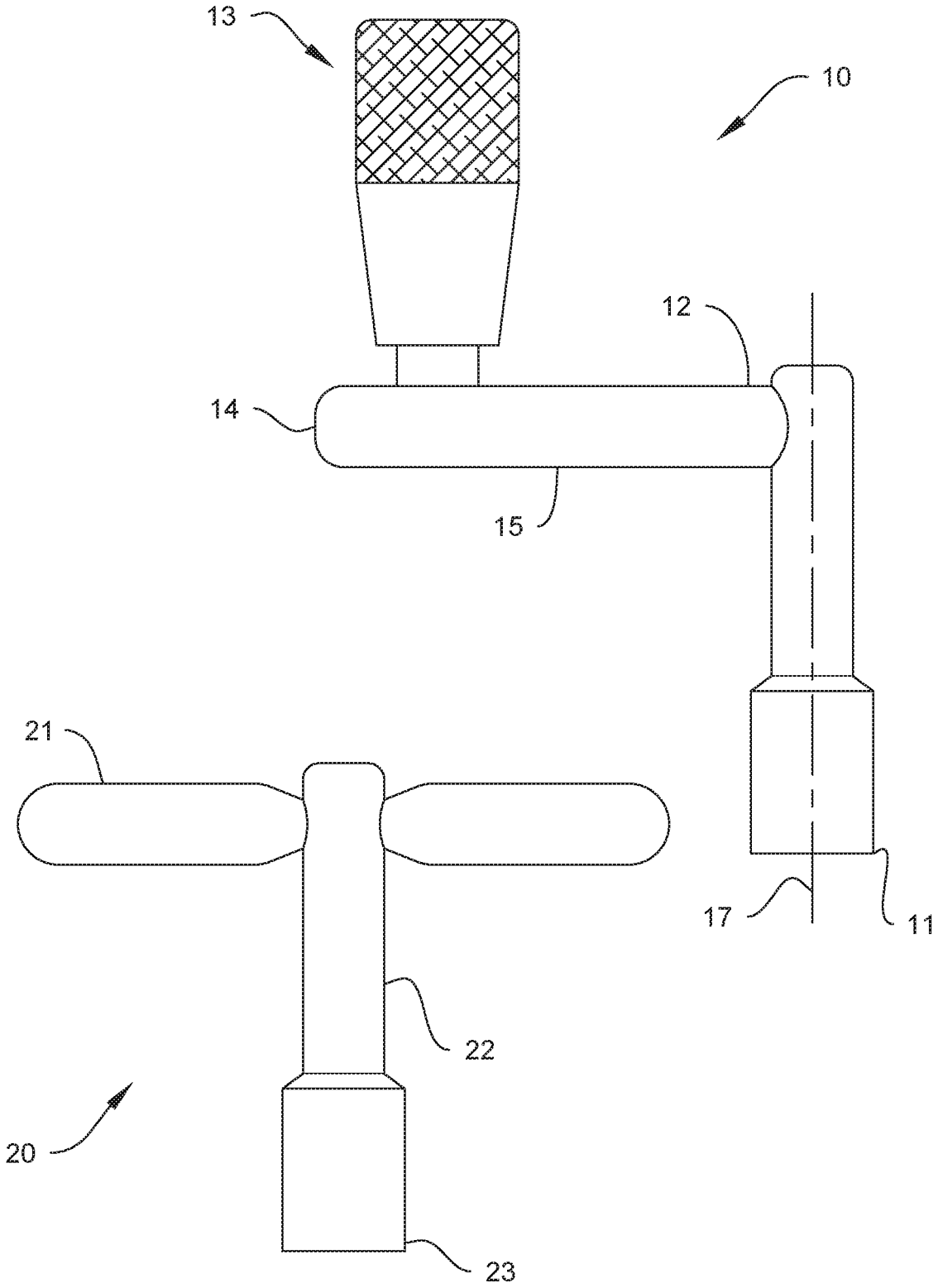
FIG. 1 (Prior Art)
FIG. 1 is a depiction of prior versions of drum key.
Figure 2:
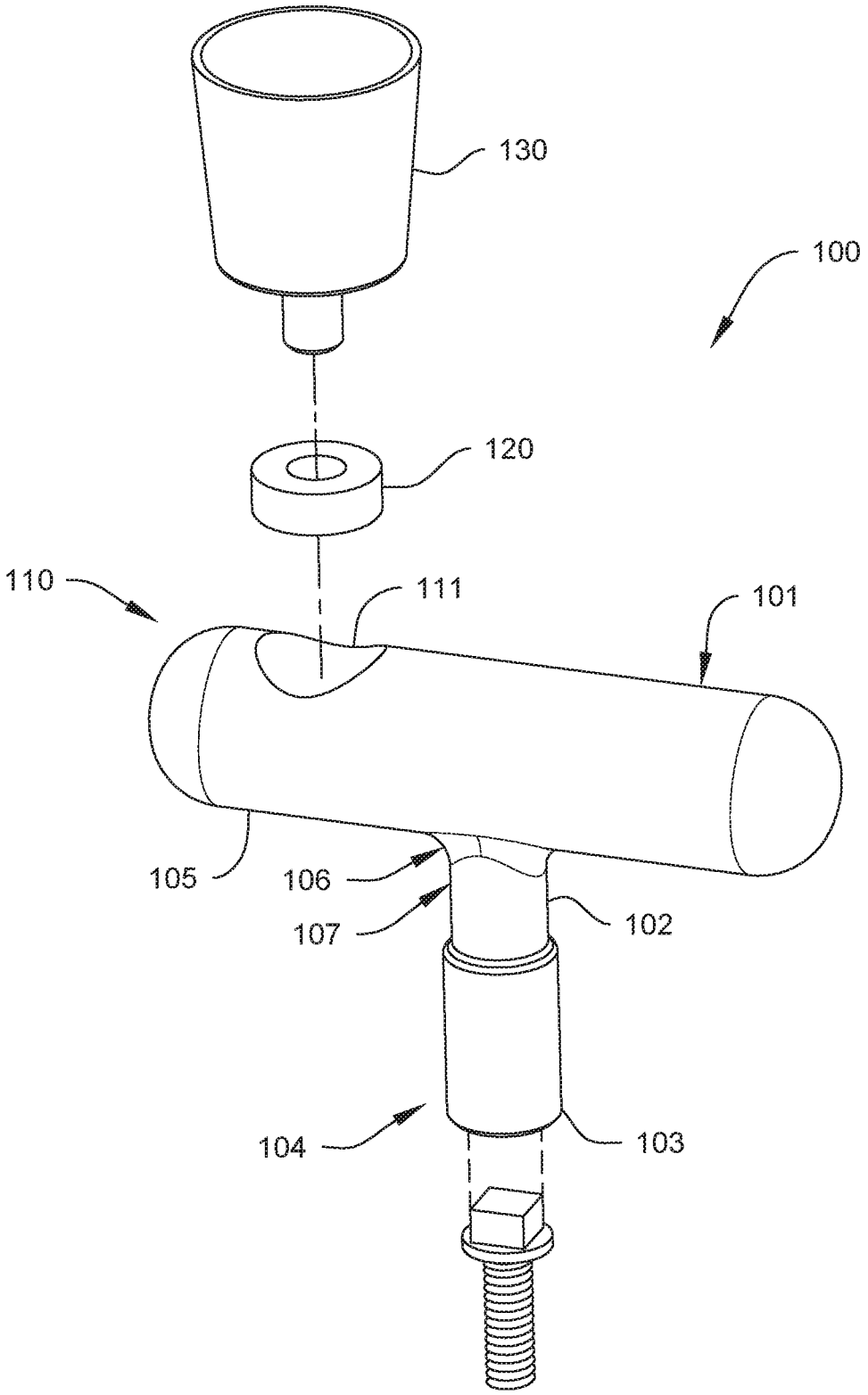
FIG. 2 is an exploded depiction of the drum speed key tool.

FIG. 2 depicts a preferred embodiment of the drum speed key tool and is described as follows. The drum speed key tool 100 preferably comprises a T-handle shape 101 made from perpendicular members. The first member 102 has a socket 103 at a first end 104 and is affixed or joined to a cross member's 105 medial point 106 at a second end 107 of the first member forming a "T" shape. At a first end 110 of the cross member 105 there is preferably formed a cavity 111 for receiving a bearing 120 on the superior side of the cross member. A bearing 120 is then seated within cavity 111 and the finger receiving cup 130 is then pressed into the bearing 120 allowing rotation of the finger receiving cup 130. Alternatively, the first member and cross member can be oriented in various configurations including an "L" shaped configuration wherein the finger receiving cup is positioned at a first end of the cross member and the first member is positioned at the second end of the cross member.

Figure 3:
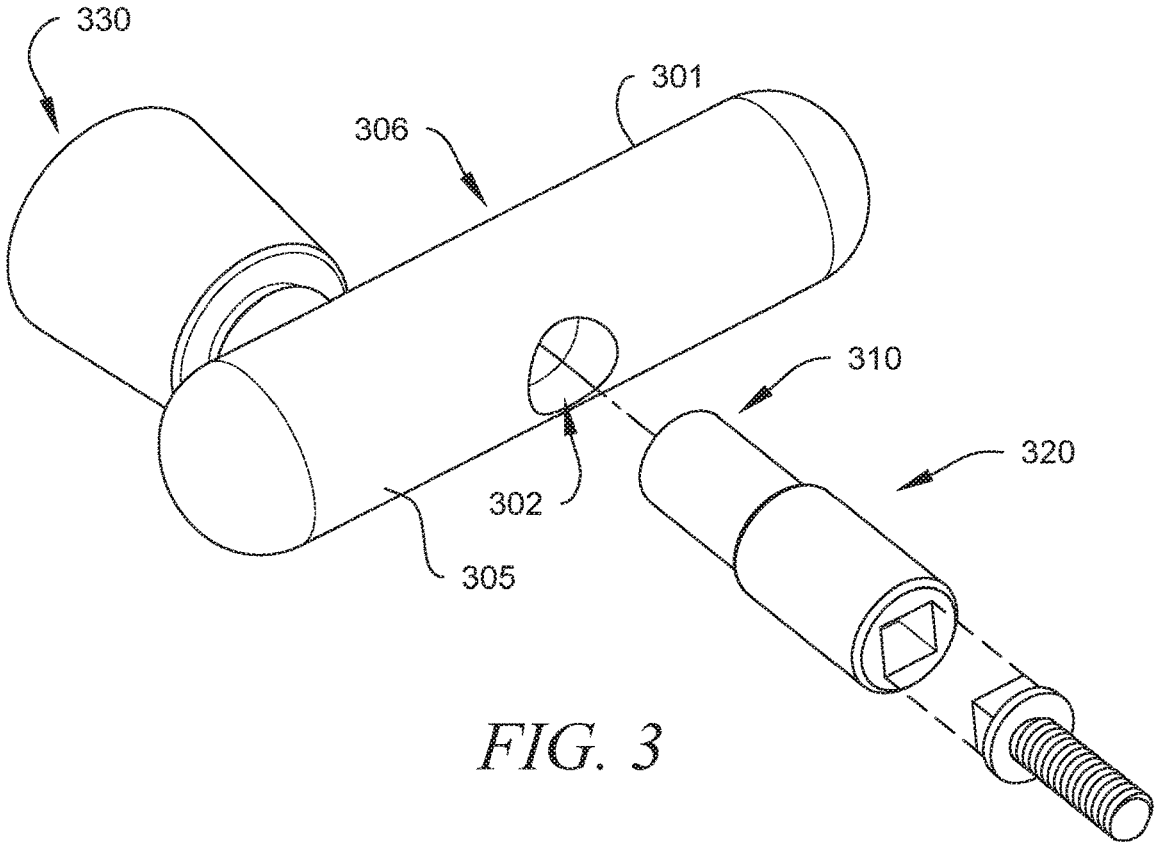
FIG. 3 is an isometric depiction of an alternative embodiment of the drum speed key tool.
Figure 4:
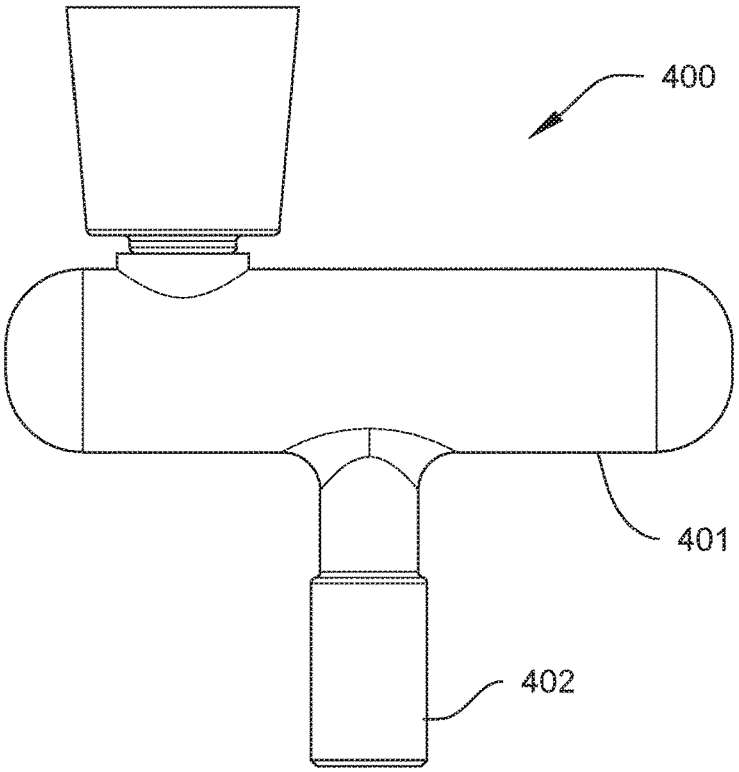
FIG. 4 is a side profile depiction of a preferred embodiment of the drum speed key tool.

The drum speed key tool 100 can be made through the process of milling or forging the finger receiver cup 130. Preparation of the cross member 105 begins by cutting a bearing hole 111 and pressing the bearing 120 into the made bearing hole 111. With reference to FIG. 3, the cross member 301 can then have a receiving hole cut 302 or formed on the bottom surface 305 of the cross member to receive a connecting end 310 of the lug receiving member 320. The lug receiving member connecting end 310 is then joined to the cross member 301. The finger receiving cup 330 is then pressed into the bearing situated on the top surface 306 of the cross member. FIG. 4. Alternatively, the "T" shaped drum speed key 400 comprising a cross member 401 and a lug receiving member 402 can be made from a single piece of metal or high-density polymer rather than joining the two members together. It should be appreciated that the steps described herein can be performed in various orders or configurations to achieve the same final assembled tool.

Figure 5:
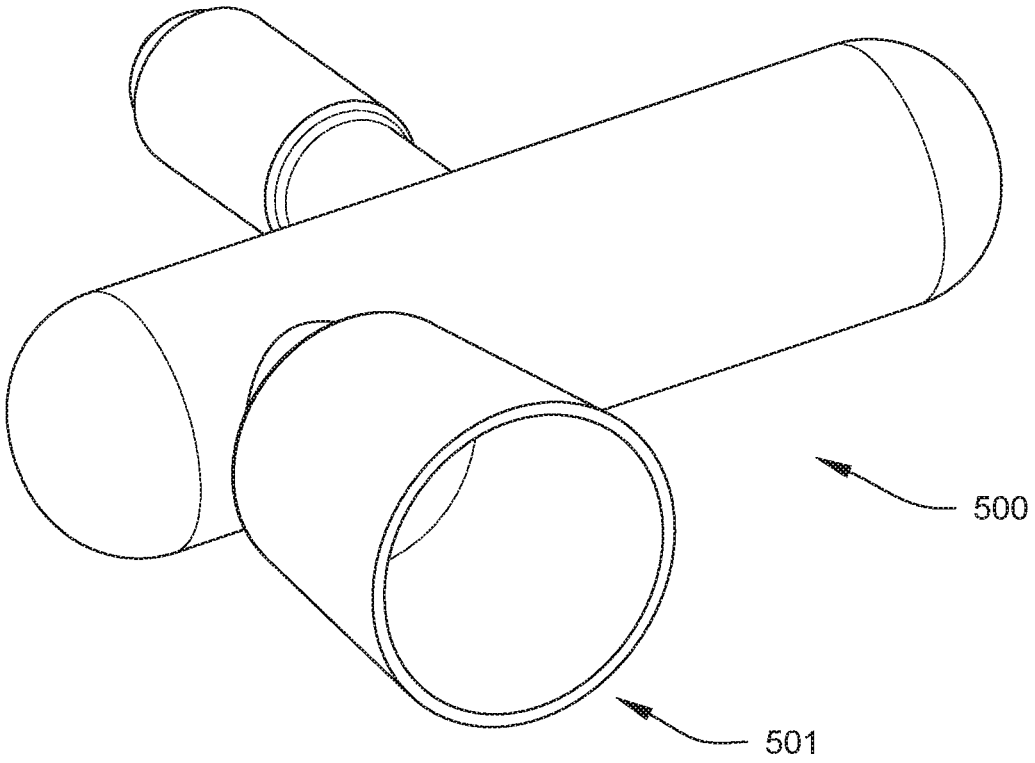
FIG. 5 provides an alternative view of the preferred embodiment of the drum speed key tool.

The drum speed key tool disclosed herein is preferably made of aluminum for strength and weight considerations, but other materials for the components may be substituted such as stainless steel or high-density polymer. As an exemplary embodiment, the square lug receiver end should have an internal measurement of 5.461 mm (0.215 inches) across for standard drum lugs. The outside measurement of the lug receiver end can be 15.05 mm (0.5925 inches). It should be appreciated that these measurements described herein may be varied to appropriate mate with the lugs to be used in conjunction with the drum speed key tool. FIG. 5 The overall size of the drum speed key tool 500 and size of the components, such as the finger receiving cup 501, can be varied to allow options for users to select and use the most appropriate size tool for their particular application or capabilities. Some users may have larger fingers or hands than other users and thus may require a larger finger receiving cup for proper operation of the drum speed key tool.

The invention claimed is:

1. An apparatus comprising:

a handle comprising a first member and a cross member;

the first member comprising a first end and a second end;

the cross member comprising a first end and a medial point;

the first end of first member comprising a socket, and the second end of first member being joined to the cross member at the medial point of the cross member;

the first end of the cross member comprising a cavity formed on a superior surface of the cross member;

a bearing seated within the cavity; and a finger receiving cup, wherein the finger receiving cup is positioned at the first end of the cross member.

2. The apparatus of claim 1, wherein the finger receiving cup is pressed into the bearing seated within the cavity.

3. The apparatus of claim 2, wherein the socket comprises an inner dimension of 0.215 inches across.

4. The apparatus of claim 1, wherein the socket comprises an inner dimension of 0.215 inches across.

5. A drum speed key tool comprising:

a cross member;

a lug receiving member; and a finger receiving cup.

6. The drum speed key tool of claim 5, wherein:

the cross member further comprises a bearing hole formed on a top surface of the cross member, and a bearing pressed into the bearing hole.

7. The drum speed key tool of claim 6, wherein:

the cross member further comprises a receiving hole formed on a bottom surface of the cross member.

8. The drum speed key tool of claim 7, wherein:

the lug receiving member further comprises a connecting end, wherein the lug receiving member connecting end is joined to the cross member receiving hole.

9. The drum speed key tool of claim 8, wherein:

the finger receiving cup is pressed into the bearing.

10. The drum speed key tool of claim 9, wherein:

the cross member and lug receiving member are joined to form a "T" shape.

11. The drum speed key tool of claim 9, wherein:

the cross member and the lug receiving member are comprised of a metal.

12. The drum speed key tool of claim 9, wherein:

the cross member and the lug receiving member are comprised of a polymer plastic.

13. The drum speed key tool of claim 6, wherein:

the cross member and the lug receiving end are formed from a single piece of material.

14. The drum speed key tool of claim 13, wherein:

the single piece of material is a metal.

15. The drum speed key tool of claim 13, wherein:

the single piece of material is a polymer.

16. A drum key tool for rotating drum lugs comprising:

a handle comprising a first member and a cross member, the first member comprising a first end and a second end, the first end comprising a socket, the cross member comprising a first end, a medial point, and a cavity, wherein the second end of the first member is joined to the cross member at the medial point;

a bearing, wherein the bearing is positioned within the cavity;

a finger receiving cup, wherein the finger receiving cup is rotationally joined to the bearing.

* * * * *